US008186195B2

(12) United States Patent
Felkl

(10) Patent No.: US 8,186,195 B2
(45) Date of Patent: May 29, 2012

(54) OPERATING METHOD FOR A MULTI-STAND ROLLING MILL TRAIN WITH STRIP THICKNESS DETERMINATION ON THE BASIS OF THE CONTINUITY EQUATION

(75) Inventor: Hans-Joachim Felkl, Forchheim (DE)

(73) Assignee: Siemens Aktiengesellschaft, Munich (DE)

( * ) Notice: Subject to any disclaimer, the term of this patent is extended or adjusted under 35 U.S.C. 154(b) by 35 days.

(21) Appl. No.: 12/867,782

(22) PCT Filed: Feb. 10, 2009

(86) PCT No.: PCT/EP2009/051503

§ 371 (c)(1),
(2), (4) Date: Aug. 16, 2010

(87) PCT Pub. No.: WO2009/106422

PCT Pub. Date: Sep. 3, 2009

(65) Prior Publication Data

US 2010/0326155 A1 Dec. 30, 2010

(30) Foreign Application Priority Data

Feb. 27, 2008 (DE) ..... 10 2008 011 275

(51) Int. Cl.
*B21B 37/58* (2006.01)

(52) U.S. Cl. ..... 72/10.3

(58) Field of Classification Search ..... 72/10.3, 72/240, 234, 365.2

See application file for complete search history.

(56) References Cited

U.S. PATENT DOCUMENTS 4,011,743 A * 3/1977 Peterson et al. ..... 72/10.3
4,506,532 A 3/1985 Anbe

FOREIGN PATENT DOCUMENTS

| | | |
|---|---|---|
| DE | 3303829 | 8/1983 |
| JP | 63137510 | 6/1988 |
| JP | 63199011 | 8/1988 |
| JP | 4158912 | 6/1992 |
| JP | 6210338 | 8/1994 |
| JP | 8141613 | 6/1996 |

OTHER PUBLICATIONS

International Search Report and Written Opinion for Application No. PCT/EP2009/051503 (11 pages), Apr. 16, 2009.

* cited by examiner

*Primary Examiner* — Faye Francis
(74) *Attorney, Agent, or Firm* — King & Spalding L.L.P.

(57) ABSTRACT

A strip is fed a rolling stand of a multi-stand rolling mill with a known inlet thickness and exits with a strip thickness. Measurement parameters are determined that are characteristic of the inlet-side and outlet-side strip velocities. With the measurement parameters, the inlet-side and outlet-side strip velocities are determined with respect to the rolling stand. With the inlet thickness, the inlet-side and outlet-side strip velocities, the strip thickness is determined with respect to the rolling stand. Taking into account the determined strip thickness, further measures are taken. The measurement parameter for the inlet-side velocity is the roller peripheral velocity directly prior to the rolling stand. Alternatively or in addition, the measurement parameter for the outlet-side velocity is the roller peripheral velocity. The peripheral precession of the strip is modeled. The respective strip velocity is determined using the respective roller peripheral velocity and the peripheral strip precession in the respective rolling stand.

10 Claims, 5 Drawing Sheets

OPERATING METHOD FOR A MULTI-STAND ROLLING MILL TRAIN WITH STRIP THICKNESS DETERMINATION ON THE BASIS OF THE CONTINUITY EQUATION

CROSS-REFERENCE TO RELATED APPLICATIONS

This application is a U.S. National Stage Application of International Application No. PCT/EP2009/051503 filed Feb. 10, 2009, which designates the United States of America, and claims priority to DE Application No. 10 2008 011 275.5 filed Feb. 27, 2008. The contents of which are hereby incorporated by reference in their entirety.

TECHNICAL FIELD

The present invention relates to an operating method for a multi-stand rolling mill train,

- wherein a strip is fed to one of the rolling stands (the rolling stand in question) of the rolling mill train with a known input thickness and exits the rolling stand in question with a strip thickness,
- wherein measurement variables characteristic of the inlet-side velocity of the strip and the outlet-side velocity of the strip with respect to the rolling stand in question are detected,
- wherein the inlet-side velocity of the strip and the outlet-side velocity of the strip are determined with respect to the rolling stand in question on the basis of the detected measurement variables,
- wherein the strip thickness is determined with respect to the rolling stand in question on the basis of the input thickness, the inlet-side velocity of the strip and the outlet-side velocity of the strip,
- wherein further measures are taken in the light of the determined strip thickness.

The present invention furthermore relates to a computer program, which comprises machine code which can be executed directly by a control device for a multi-stand rolling mill train, the execution of the machine code by the control device having the effect that the control device operates the rolling mill train in accordance with such an operating method. The present invention also relates to a data storage medium having such a computer program which is stored on the data storage medium in machine-readable form.

Furthermore, the present invention relates to a control device for a multi-stand rolling mill train, the control device being designed in such a manner that it operates the rolling mill train in accordance with an operating method of the type described above.

Finally, the present invention relates to a rolling mill train,

- wherein the rolling mill train has a plurality of rolling stands through which a strip passes in succession,
- wherein the rolling mill train can have a front thickness-measuring device which is arranged immediately prior to one of the rolling stands of the rolling mill train (rolling stand in question), or the rolling stand in question can be the first rolling stand of the rolling mill train,
- wherein the rolling mill train has a control device of the type described above,
- wherein the control device, the rolling stands and, if present, the thickness-measuring device are connected to one another by a data link.

BACKGROUND

The subjects described above are generally known. Purely by way of example, reference is made to JP 04-158 912 A and JP 06-210 338 A.

DE 33 03 829 A1 discloses an operating method for a multi-stand rolling mill train, in which method, inter alia, the peripheral precession of a strip in a roll nip of a rolling stand is determined. The inlet-side and the outlet-side strip thickness, inter alia, are required to determine the peripheral precession.

In the case of multi-stand cold-rolling mills, the strip thickness—i.e. the thickness with which the strip exits in each case one of the rolling stands—is generally only measured downstream from the first and downstream from the last rolling stand. No such measurement of the strip thickness takes place downstream from the remaining rolling stands of the rolling mill train (intermediate stands). Strip thickness defects may therefore arise as a result of the rolling in the intermediate stands, and these defects are only detected downstream from the last rolling stand. Although, in the prior art, a control command is determined for the last or the penultimate rolling stand of the rolling mill train and output to the corresponding rolling stand owing to the detection of the strip thickness defect, this procedure only makes it possible to correct strip thickness defects which occur with a relatively long delay. This is true particularly when the control command is intended for the penultimate rolling stand of the rolling mill train. Furthermore, only late correction of a strip thickness defect which has occurred takes place.

Complete correction of a strip thickness defect is also not always possible.

It would be advantageous if the strip thickness with which the strip exits the respective rolling stand were known for each rolling stand. This is because strip thickness defects which have occurred could then be corrected immediately or other measures could be taken.

For this purpose, it is conceivable to arrange a thickness-measuring device downstream from each rolling stand. However, thickness-measuring devices are expensive and therefore are not used in practice.

Furthermore, it is conceivable to detect the rolling force, with which the strip is rolled in the intermediate stand, for each intermediate stand, and to determine, on the basis of the set roll nip of said intermediate stand and the respective rolling force in conjunction with the spring constant of the respective intermediate stand, the extent to which the intermediate stand in question expands, and to thus determine the effective roll nip and therefore the strip thickness. However, this procedure is too inaccurate and is therefore not employed in practice.

SUMMARY

According to various embodiments, possible ways to determine the strip thickness of a strip exiting a rolling stand in question can be provided in a simple, reliable and precise manner, without a thickness-measuring device arranged after the rolling stand in question being required.

According to an embodiment, an operating method for a multi-stand rolling mill train, wherein a strip is fed to one of the rolling stands (the rolling stand in question) of the rolling mill train with a known input thickness and exits the rolling stand in question with a strip thickness, may comprise: detecting measurement variables characteristic of the inlet-side velocity of the strip and the outlet-side velocity of the strip with respect to the rolling stand in question, determining the inlet-side velocity of the strip and the outlet-side velocity of the strip with respect to the rolling stand in question on the basis of the detected measurement variables, determining the strip thickness is determined with respect to the rolling stand in question on the basis of the input thickness, the inlet-side velocity of the strip and the outlet-side velocity of the strip, taking further measures in the light of the determined strip thickness, wherein the measurement variable for the inlet-side velocity of the strip is the roller circumferential velocity of the rolling stand arranged immediately prior to the rolling stand in question and/or the measurement variable for the outlet-side velocity of the strip is the roller circumferential velocity of the rolling stand in question, modeling the peripheral precession of the strip in the respective rolling stand, and determining the respective velocity of the strip on the basis of the respective roller circumferential velocity and the peripheral precession of the strip in the respective rolling stand.

According to a further embodiment, the strip may consist of successive sections, a respective section thickness may be associated with each section at any point in time, the displacement of the sections as they pass through the rolling mill train may be monitored, and the section thickness of each section may correspond to the input thickness before said section enters the rolling stand in question and to the strip thickness after said section exits the rolling stand in question. According to a further embodiment, the input thickness can be measured by means of a front thickness-measuring device arranged prior to the rolling stand in question. According to a further embodiment, the front thickness-measuring device can be arranged between the first and the second rolling stands of the rolling mill train. According to a further embodiment, a rolling stand can be arranged immediately prior to the rolling stand in question, and the strip thickness for the rolling stand arranged immediately prior to the rolling stand in question can be determined by means of an operating method as described above. According to a further embodiment, the further measures may include displaying the determined strip thickness. According to a further embodiment, the further measures may include determining a control command for the rolling stand in question and/or at least one rolling stand of the rolling mill train which differs from the rolling stand in question. According to a further embodiment, an outlet thickness of the strip can be detected by means of a rear thickness-measuring device arranged after the rolling stand in question, and the further measures may include comparing the strip thickness determined for the rolling stand in question with the measured outlet thickness. According to a further embodiment, the inlet-side velocity of the strip and/or the outlet-side velocity of the strip can be determined with respect to at least one of the rolling stands in question on the basis of the detected measurement variables using a determination method, and the determination method can be adapted on the basis of the comparison. According to a further embodiment, an error message can be output if the determined strip thickness differs excessively from the measured outlet thickness.

According to another embodiment, a computer program may comprise machine code which can be executed directly by a control device for a multi-stand rolling mill train, the execution of the machine code by the control device having the effect that the control device operates the rolling mill train in accordance with an operating method as described above.

According to yet another embodiment, a data storage medium may have a computer program as described above stored on the data storage medium in machine-readable form.

According to yet another embodiment, a control device for a multi-stand rolling mill train, may be designed in such a manner that it operates the rolling mill train in accordance with an operating method as described above.

According to a further embodiment of the control device, the control device may be in the form of a programmable control device which, during operation, executes a computer program as described above.

According to yet another embodiment, a rolling mill train may comprise a plurality of rolling stands through which a strip passes in succession, for at least one of the rolling stands (rolling stand in question) of the rolling mill train, detection devices, which can be used to detect measurement variables characteristic of the inlet-side velocity of the strip and the outlet-side velocity of the strip with respect to the rolling stand in question, wherein at least one of the measurement variables is the roller circumferential velocity of the rolling stand in question or of the rolling stand arranged immediately prior to the rolling stand in question, wherein the rolling mill train either has a front thickness-measuring device, which is arranged immediately prior to the rolling stand in question and can be used to measure the input thickness for the rolling stand in question, or has a determination device, which can be used to determine the input thickness for the rolling stand in question on the basis of variables which are fed to the determination device and are related to a rolling stand arranged immediately prior to the rolling stand in question, or the rolling stand in question is the first rolling stand of the rolling mill train, and a control device as described above, wherein the control device, the rolling stands, the detection devices and, if present, the thickness-measuring device and the determination device are connected to one another by a data link.

BRIEF DESCRIPTION OF THE DRAWINGS

Further advantages and details will emerge from the following description of exemplary embodiments in conjunction with the drawings, in which, in outline form.

DETAILED DESCRIPTION

Figure 1:
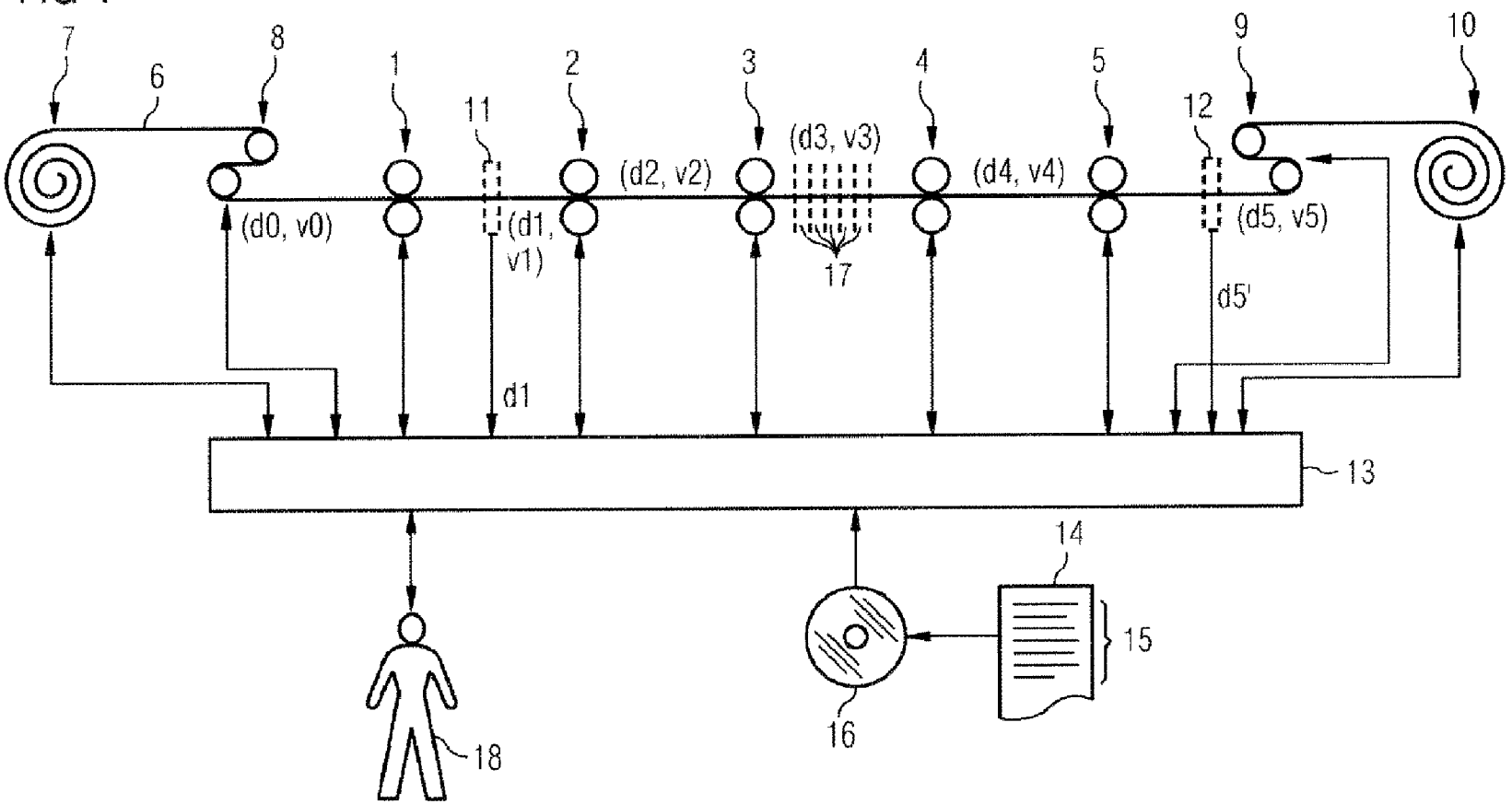
FIG. 1 schematically shows the design of a multi-stand rolling mill train.

According to various embodiments, an operating method of the type mentioned in the introduction is configured

- in that the measurement variable for the inlet-side velocity of the strip is the roller circumferential velocity of the rolling stand arranged immediately prior to the rolling stand in question and/or the measurement variable for the outlet-side velocity of the strip is the roller circumferential velocity of the rolling stand in question,
- in that the peripheral precession of the strip in the respective rolling stand is modeled, and
- in that the respective velocity of the strip is determined on the basis of the respective roller circumferential velocity and the peripheral precession of the strip in the respective rolling stand.

The thickness-measuring device required in the prior art is therefore realized indirectly and arithmetically. A "soft sensor", as it were, is used.

According to a further embodiment, the strip consists of successive sections, a respective section thickness being associated with each section at any point in time. The displacement of the sections as they pass through the rolling mill train is monitored. The section thickness of each section corresponds to the input thickness before said section enters the rolling stand in question and to the strip thickness after said section exits the rolling stand in question. Improved dynamics when correcting strip thickness defects are possible owing to this procedure. It is possible that the input thickness is measured by means of a front thickness-measuring device arranged prior to the rolling stand in question. In particular, in the case of prior art multi-stand rolling mill trains, a front thickness-measuring device is often arranged between the first and the second rolling stands of the rolling mill train. This refinement can also be retained in the context of the present invention. In principle, the arrangement of the front thickness-measuring device—if it is required—is freely selectable. By way of example, it could also be arranged prior to the first rolling stand of the rolling mill train.

As an alternative to the measurement of the input thickness by means of a thickness-measuring device, it is possible that a rolling stand is arranged immediately prior to the rolling stand in question, and that the strip thickness for the rolling stand arranged immediately prior to the rolling stand in question is determined by means of an operating method as described above.

By way of example, the further measures can include displaying the determined strip thickness. Alternatively or in addition, it is possible to determine a control command for the rolling stand in question and/or at least one rolling stand which differs from the rolling stand in question.

As has likewise already been mentioned, a rear thickness-measuring device is often arranged after the last rolling stand of the rolling mill train in the case of prior art multi-stand rolling mill trains. This refinement can also be retained in the context of the present invention. For each rolling stand of the rolling mill train which has a rear thickness-measuring device arranged after it, it is possible that an outlet thickness of the strip is detected by means of the rear thickness-measuring device, and that the further measures include comparing the strip thickness determined for the rolling stand in question with the measured outlet thickness. By way of example, it is possible that the inlet-side velocity of the strip and/or the outlet-side velocity of the strip are determined with respect to at least one of the rolling stands in question on the basis of the detected measurement variables using a determination method. In this case, the determination method can be adapted, for example, on the basis of the comparison.

Alternatively or in addition, it is possible that an error message is output if the determined strip thickness differs excessively from the measured outlet thickness. It is therefore possible to carry out plausibility checks.

In programming terms, according to other embodiments, a computer program may comprise machine code which can be executed directly by a control device for a multi-stand rolling mill train, the execution of the machine code by the control device having the effect that the control device operates the rolling mill train in accordance with an operating method of the type explained above. In programming terms, according to other embodiments, a data storage medium may store such a computer program in machine-readable form.

In device terms, according to various embodiments, a control device for a multi-stand rolling mill train may be designed in such a manner that it operates the rolling mill train in accordance with an operating method of the type described above. In this case, the control device may in particular be in the form of a programmable control device which, during operation, executes a computer program of the type described above.

In system terms, according to respective embodiments, a rolling mill train has a plurality of rolling stands through which a strip passes in succession, the rolling mill train has, for at least one of the rolling stands (rolling stand in question) of the rolling mill train, detection devices, which can be used to detect measurement variables characteristic of the inlet-side velocity of the strip and the outlet-side velocity of the strip with respect to the rolling stand in question, wherein at least one of the measurement variables is the roller circumferential velocity of the rolling stand in question or the roller circumferential velocity of the rolling stand arranged immediately prior to the rolling stand in question, the rolling mill train either has a front thickness-measuring device, which is arranged immediately prior to the rolling stand in question and can be used to measure the input thickness for the rolling stand in question, or has a determination device, which can be used to determine the input thickness for the rolling stand in question on the basis of variables which are fed to the determination device and are related to a rolling stand arranged immediately prior to the rolling stand in question, or the rolling stand in question is the first rolling stand of the rolling mill train, the rolling mill train has a control device of the type described above, and the control device, the rolling stands, the detection devices and, if present, the thickness-measuring device and the determination device are connected to one another by a data link.

As shown in FIG. 1, a multi-stand rolling mill train has a plurality of rolling stands 1 to 5. A strip 6 passes through the rolling stands 1 to 5 in succession. In this context, five rolling stands 1 to 5 are shown in FIG. 1. However, the rolling mill train could alternatively have more or fewer rolling stands 1 to 5, for example 3, 4, 6, 7, . . . rolling stands. Furthermore, the rolling mill train shown in FIG. 1 is in the form of a cold-rolling mill train (tandem mill train). This refinement represents the general rule. As an exception, however, the present invention could also be employed for a hot strip rolling mill.

As shown in FIG. 1, an uncoiler 7 and a front tension bridle 8 are arranged prior to the first rolling stand 1. A rear tension bridle 9 and a coiler 10 are arranged downstream from the last rolling stand 5. The presence of the coilers 7, 10 and of the tension bridles 8, 9 is customary, but not absolutely necessary.

Finally, a front thickness-measuring device 11 is arranged between the first and the second rolling stands 1, 2 of the rolling mill train. Furthermore, a rear thickness-measuring device 12 is arranged after the last rolling stand 5. The presence of the thickness-measuring devices 11, 12 is also customary, but not absolutely necessary in the context of the present invention.

The rolling stands 1 to 5, the coilers 7, 10, the tension bridles 8, 9 and the thickness-measuring devices 11, 12 are connected to a control device 13 for the multi-stand rolling mill train by a data link. The control device 13 is designed in such a manner that it operates the rolling mill train in accordance with an operating method which will be explained in detail below in conjunction with FIG. 2 to 7.

The control device 13 is generally in the form of a programmable control device 13 which, during operation, executes a computer program 14. In this context, the computer program 14 comprises machine code 15 which can be executed directly by the control device 13. In this case, the execution of the machine code 15 has the effect that the control device 13 operates the rolling mill train in accordance with an operating method according to various embodiments. The computer program 14 may already have been stored in the control device 13 during the production of the control device 13. Alternatively, it is possible to supply the computer program 14 to the control device 13 via a computer-computer link. The computer-computer link in this respect is not shown in FIG. 1. It may be in the form of a link to a LAN or to the Internet, for example. In turn, it is alternatively possible to store the computer program 14 on a data storage medium 16 in machine-readable form and to supply the computer program 14 to the control device 13 via the data storage medium 16. The design of the data storage medium 16 in this respect is arbitrary. By way of example, it is possible that the data storage medium 16 is designed as a USB memory stick or as a memory card. The data storage medium 16 is shown in the form of a CD-ROM in FIG. 1.

According to a further embodiment, the first rolling stand 1 is operated in a conventional manner rather than in the manner according to the invention. The operation of the first rolling stand 1 will be explained in more detail below in conjunction with FIG. 2.

Figure 2:
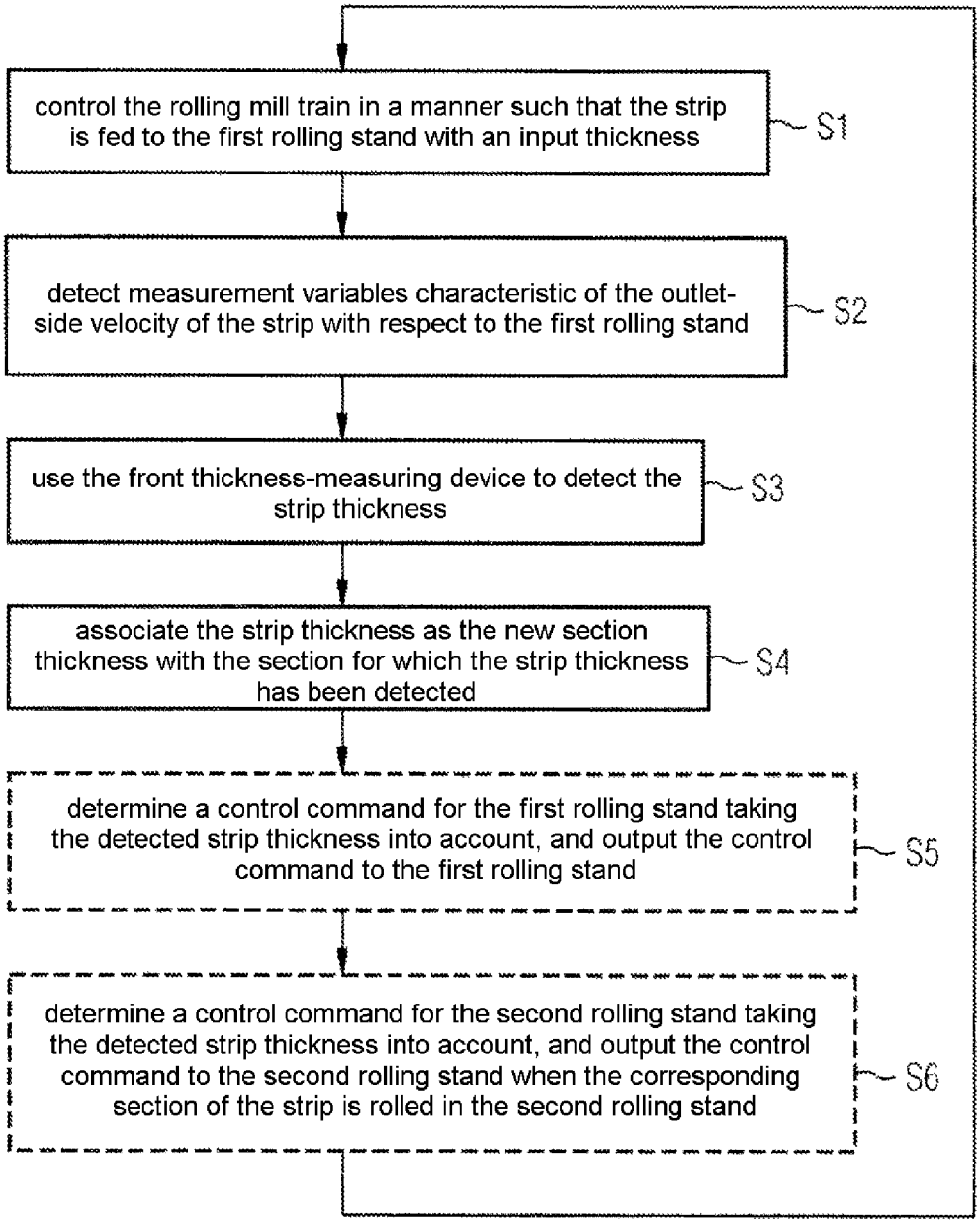
FIG. 2 to 5 show flow charts.

According to FIG. 2, in a step S1 the control device 13 controls the rolling mill train in a manner such that the strip 6 is fed to the first rolling stand 1 with an input thickness d0. In this case, the input thickness d0 may be known, for example because a further thickness-measuring device is arranged prior to the first rolling stand 1 or because the thickness of the strip 6 coiled onto the coiler 7 is known in advance. However, it is not absolutely necessary for the input thickness d0 of the strip 6 entering the first rolling stand 1 to be known.

In a step S2, measurement variables characteristic of the outlet-side velocity v1 of the strip 6 with respect to the first rolling stand 1 are detected. Furthermore, in a step S3 the front thickness-measuring device 11 is used to detect the strip thickness d1, i.e. the thickness d1 with which the strip 6 exits the first rolling stand 1. As is indicated schematically in FIG. 1, the strip 6 consists of successive sections 17. A respective section thickness d is associated with each section 17 at any point in time. The displacement of the sections 17 as they pass through the rolling mill train is monitored. Displacement monitoring in this respect is generally known to experts. Therefore, in a step S4 the control device 13 associates the strip thickness d1 as the new section thickness d with each section 17 for which the strip thickness d1 has been detected in each case by means of the front thickness-measuring device 11.

In a step S5, the control device 13 determines a control command for the first rolling stand 1. In this case, the control command is determined taking the detected strip thickness d1 into account. The determined control command is output to the first rolling stand 1 immediately after it has been determined.

Step S5 is only optional and is therefore only shown within dashed lines in FIG. 2. This is because it is possible for a step S6 to be present as an alternative or in addition to step S5. However, since step S6 is also only optional, step S6 is also only shown within dashed lines in FIG. 2.

In step S6, the control device 13 determines a control command for the second rolling stand 2 (or one of the following rolling stands 3 to 5), to be precise also taking the strip thickness d1 detected on the outlet side of the first rolling stand 1 into account. However, the control command is preferably not output to the second rolling stand 2 (or the corresponding following rolling stand 3 to 5) immediately after it has been determined, but instead only when the corresponding section 17 of the strip 6 is rolled in the second rolling stand 2 (or the corresponding following rolling stand 3 to 5). The relevant point in time can be determined readily because the displacement of the sections 17 is monitored. In contrast to the first rolling stand 1, the second, the third and the fourth rolling stands 2, 3, 4 are operated in a novel manner according to various embodiments. This procedure will be explained in more detail below, with reference to FIG. 3, for the second rolling stand 2. Analogous statements apply to the third and the fourth rolling stands 3, 4.

Figure 3:
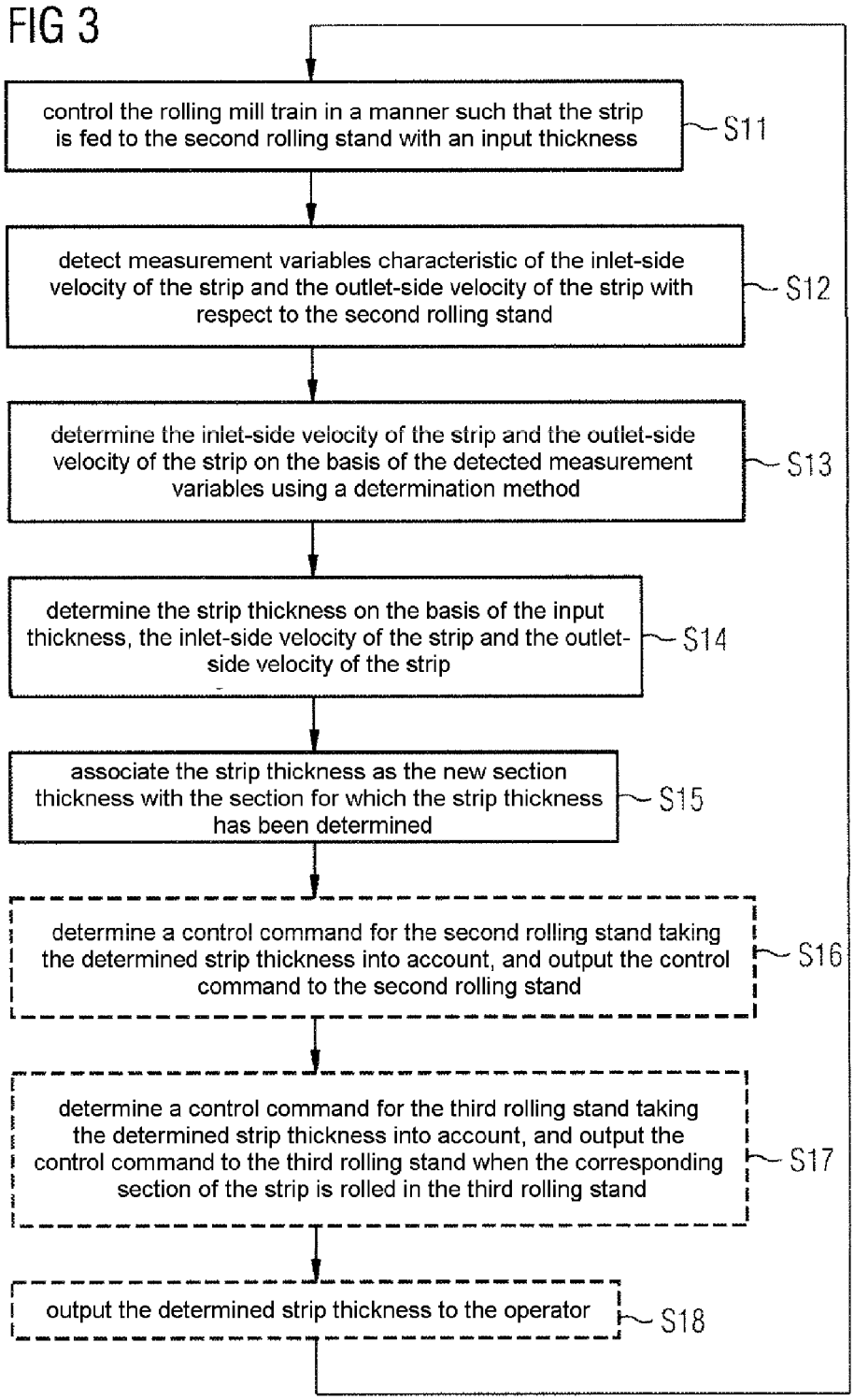

According to FIG. 3, the control device 13 controls the rolling mill train in a manner such that the strip 6 is fed to the second rolling stand 2 and exits the second rolling stand 2. In contrast to the procedure for the first rolling stand 1, here the input thickness d1 with which the strip 6 enters the rolling stand in question 2 is known. This is immediately and directly apparent for the second rolling stand 2, since the input thickness d1 corresponds to the thickness d1 which has been detected by means of the front thickness-measuring device 11.

In a step S12, measurement variables characteristic of the inlet-side velocity v1 of the strip 6 and the outlet-side velocity v2 of the strip 6 with respect to the second rolling stand 2 are detected. Possible measurement variables will be explained in more detail below in conjunction with FIG. 6.

In a step S13, the control device 13 determines the inlet-side velocity v1 of the strip 6 and the outlet-side velocity v2 of the strip 6 with respect to the second rolling stand 2 on the basis of the measurement variables detected in step S12 (and indeed the current measurement variables).

In a step S14, the control device 13 determines the strip thickness d2 with respect to the second rolling stand 2 on the basis of the input thickness d1, the inlet-side velocity v1 of the strip 6 and the outlet-side velocity v2 of the strip 6, i.e. the strip thickness d2 with which the strip 6 exits the second rolling stand 2. In this context, the strip thickness is determined on the basis of the continuity equation, i.e. on the basis of the following relationship:

$$d2 = \frac{v1}{v2} \cdot d1$$

The outlet-side strip thickness d2 is of course determined for that section 17 of the strip 6 which is currently being rolled.

Furthermore, in a step S15 the strip thickness d2 determined in step S14 is associated with the corresponding section 17 as the new section thickness d thereof. As a result of this procedure, the section thickness d of each section 17 corresponds to the input thickness d1 before said section enters the second rolling stand 2 and to the strip thickness d2 after said section exits the second rolling stand 2.

Further measures are then taken in the light of the determined strip thickness d2. In this context, the further measures generally include at least one of steps S16, S17 and S18. Since each individual one (if not all together) of steps S16, S17 and S18 is optional, steps S16, S17 and S18 are shown within dashed lines in FIG. 3.

In step S16, the control device 13 determines a control command for the second rolling stand 2. In this case, the control command is determined taking the strip thickness d2 determined in step S14 into account. The determined control command is output to the second rolling stand 2 immediately after it has been determined.

In step S17, the control device 13 determines a control command for the third rolling stand 3 (or a following rolling stand 4, 5). Here, the control command for the third rolling stand 3 (or the corresponding following rolling stand 4, 5) is likewise determined taking the strip thickness d2 with which the strip 6 exits the second rolling stand 2 into account. However, the control command for the third rolling stand 3 (or the corresponding following rolling stand 4, 5) is preferably not output immediately to the third rolling stand 3 (or the corresponding following rolling stand 4, 5), but instead only when the corresponding section 17 enters the third rolling stand 3 (or the corresponding following rolling stand 4, 5).

Conceptually, steps S16 and S17 correspond to steps S5 and S6 of FIG. 2. The corresponding statements made in relation to steps S5 and S6 therefore apply, i.e. both steps S16, S17 may be present.

In step S18, the determined strip thickness d2 is displayed to the operator 18, for example using a display device.

As already mentioned, analogous statements apply to the third and the fourth rolling stands 3, 4. The only significant difference is that the input thickness d1 for the second rolling stand 2 is a measured variable, whereas, for the third and the fourth rolling stands 3, 4, the respective input thickness d2, d3 is determined on the basis of the procedure explained above in conjunction with FIG. 2, applied to the rolling stand 2 or 3 arranged immediately prior to said rolling stands 3, 4.

The input thickness d4 for the last rolling stand 5 of the rolling mill train is also determined according to the method explained above in conjunction with FIG. 3. Furthermore, the last rolling stand 5 is also operated in a manner according to various embodiments. However, it differs from the procedure explained above in conjunction with FIG. 3. The procedure for the last rolling stand 5 will be explained in more detail below in conjunction with FIG. 4. However, since the procedure of FIG. 4 largely corresponds to the procedures of FIGS. 2 and 3, reference is made, where possible, to the explanations relating to the latter.

Figure 4:
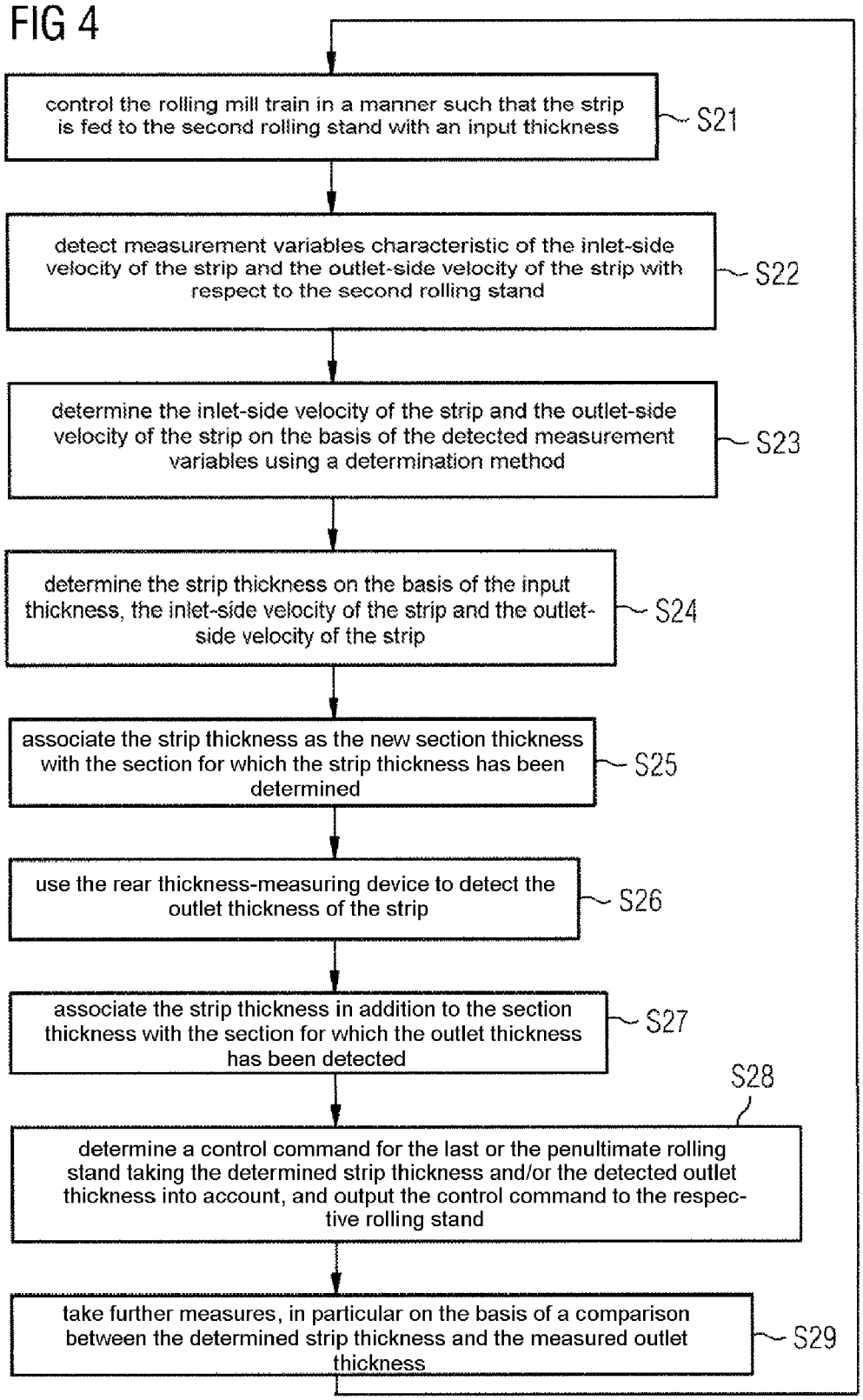

According to FIG. 4, the control device 13 executes steps S21 to S25. With the exception of the fact that they relate to the last rolling stand 5, steps S21 to S25 correspond to steps S11 to S15 of FIG. 3, and so reference is made to the statements made in relation to the latter. Furthermore, the control device 13 executes steps S26 and S27. With the exception of the fact that they relate to the last rolling stand 5 and the detected thickness d5' is denoted as the outlet thickness d5' in order to distinguish it from the strip thickness d5, steps S26 and S27 correspond to steps S3 and S4 of FIG. 2, and so reference can be made to the statements made in relation to the latter.

Furthermore, the control device 13 executes a step S28. In step S28, the control device 13 determines a control command for the last rolling stand 5 and/or for the penultimate rolling stand 4. The control command is output to the corresponding rolling stand 5 or 4 immediately after it has been determined. In terms of basic approach, step S28 corresponds to step S5 of FIG. 2 or to step S16 of FIG. 3, and so reference can be made to the statements made in relation to the latter. However, the control command can be determined taking the strip thickness d5 determined in step S24 into account or taking the final thickness d5' of the strip 6 detected in step S26 into account (or a combination of the two thicknesses d5, d5'). In this case, determination taking the detected final thickness d5' into account is preferable.

Finally, the control device 13 executes a step S29. In step S29, the control device 13 takes further measures. In this context, the control device 13 preferably takes the further measures on the basis of a comparison between the strip thickness d5 determined for the last rolling stand 5 of the rolling mill train and the measured final thickness d5'.

Figure 5:
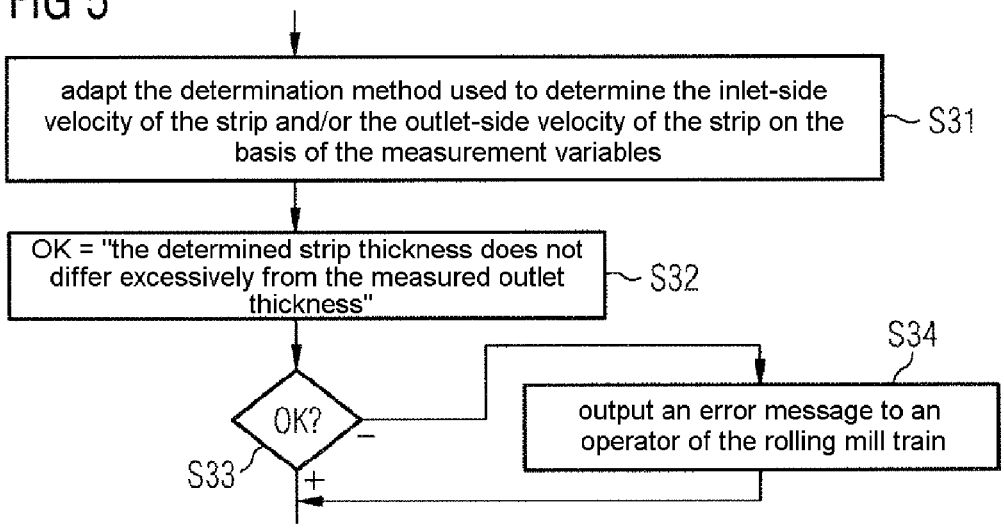

According to FIG. 5, the further measures of step S29 can include a step S31, for example. In step S31, the control device 13 adapts the determination method used to determine the inlet-side velocity v1 to v4 of the strip 6 and/or the outlet-side velocity v2 to v5 of the strip 6 in the context of steps S13 and S23.

As an alternative or in addition to step S31, steps S32 to S34 may be present according to FIG. 5. In step S32, the control device 13 determines the value of a logic variable OK. In this case, the logic variable OK assumes the value TRUE when, and only when, the determined strip thickness d5 does not differ excessively from the measured outlet thickness d5'. Otherwise, the logic variable OK assumes the value UNTRUE.

In step S33, the control device 13 checks the value of the logic variable OK. Depending on the result of the check, the control device 13 executes step S34, in which it outputs an error message to an operator 18 of the rolling mill train.

Steps S32 to S34 therefore correspond to a plausibility check, and so it is possible to detect a defect. By way of example, in this respect the defect may have occurred in one of the thickness-measuring devices 11, 12 or in one of the measuring devices which detect the measurement variables characteristic of the inlet-side velocity v1 to v4 or the outlet-side velocity v2 to v5 of the strip 6.

Various procedures for determining the velocities v0 to v5 of the strip 6 will be explained below in conjunction with FIG. 6. Here, the procedures can be employed alternatively. In particular, it is sufficient to carry out one of the procedures described below in conjunction with FIG. 6 for each velocity v0 to v5 to be determined. Furthermore, although it is customary and generally the case that all velocities v0 to v5 are determined in the same way, this is not absolutely necessary. Instead, it is possible to carry out a procedure which is in each case particularly suitable for each individual velocity v0 to v5. In particular, it is therefore possible, for (at least) one of the rolling stands 1 to 5, to determine the inlet-side velocity v0 to v4 of the strip 6 and the outlet-side velocity v1 to v5 of the strip 6 in different ways.

The possible procedures will be explained below in conjunction with FIG. 6 on the basis of a section of the rolling mill train which is delimited by two rolling stands 1 to 5 delimiting the section, here the rolling stands 3 and 4. The statements made in relation to FIG. 6 are, however, readily transferrable to the other rolling stands 1, 2 and 5 of the rolling mill train.

Figure 6:
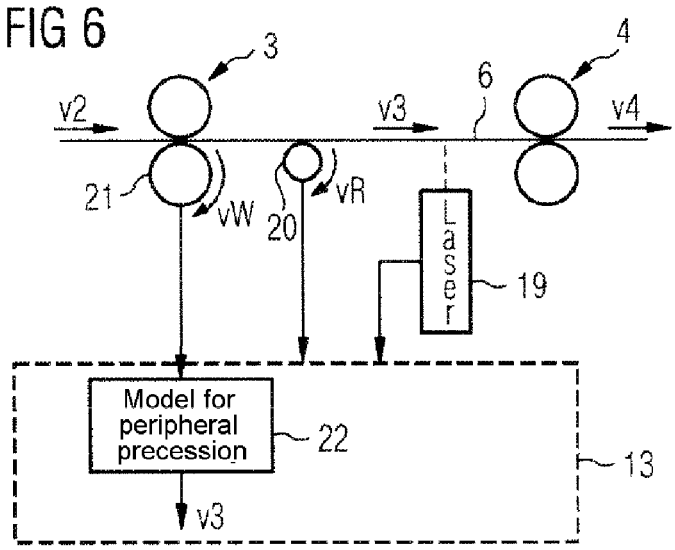
FIG. 6 shows a section of a multi-stand rolling mill train.

As can be seen from FIG. 6, it is possible, for example, to provide a measuring device 19 in the form of a laser. In this case, the respective velocity v0 to v5 of the strip 6 is detected by means of a laser measuring method. Furthermore, in this case the detected measurement variable corresponds directly to the respective velocity v0 to v5 of the strip 6.

Alternatively, it is possible to provide a roller 20 as the measuring device, the circumferential velocity vR of said roller being detected. In this case, the roller 20 is positioned against the strip 6 and runs along with the strip 6. Typical examples of suitable rollers 20 are the rollers of one of the tension bridles 8, 9, rollers of a loop lifter, tension-measuring rollers or rollers of a flatness-measuring unit.

The respective measurement variable vR also generally corresponds directly to the respective velocity v0 to v5 of the strip 6 when the measuring device is in the form of a roller 20.

In turn, it is alternatively possible for the measuring device, in relation to the site for which the respective velocity v1 to v5 should apply, to be in the form of rolls 21 of the prior rolling stand 3, and for the measurement variable to correspond to the circumferential velocity vW of the respective rolls 21. In this case, the circumferential velocity vW of the rolls 21 is fed to a model 22, in which the peripheral precession of the strip 6 in the respective rolling stand 3 is modeled. Here, the model 22 is generally implemented within the control device 13. In this case, the model 22 determines the respective velocity v0 to v5 of the strip 6 on the basis of the respective roller circumferential velocity vW and the peripheral precession of the strip 6 in the respective rolling stand 1 to 5.

Particularly in the case of the latter procedure, the measurement variable vW is linked to the respective velocity v1 to v5 of the strip 6 by means of a scaling factor. However, the link by means of an appropriate scaling factor may also be expedient, even if to a lesser degree, for measurement variables vR detected by means of a laser 19 or a roller 20. By way of example, this will be explained in more detail below, in conjunction with FIG. 7, for the roller 20.

Figure 7:
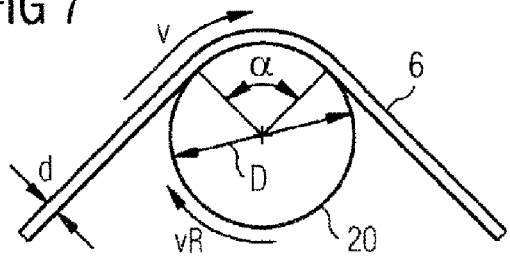
FIG. 7 shows a strip running over a roller.

According to FIG. 7, the strip 6 wraps around the roller 20 over a wrap angle α. The strip 6 moves at the strip velocity v. The roller 20 has the roller circumferential velocity vR. The strip velocity v and the roller circumferential velocity vR are linked via the following relationship:

$$v = vR\left(1 + k \cdot \frac{d}{D}\right)$$

Here, k is a factor which depends on the wrap angle α. For small wrap angles α, the factor k tends toward zero, and for increasing wrap angles α it increases. The maximum value that the factor k can assume is one. d is the local strip thickness and D is the diameter of the roller 20.

The detected measurement variables vR, vW must of course be fed to the control device 13. Irrespective of the detected measurement variable vR, vW, the corresponding measuring device 19 to 21 therefore has to be connected to the control device 13 by an appropriate data link.

It has been explained in the text above that the operating method according to various embodiments (see FIG. 3) is employed with respect to the rolling stands 2, 3 and 4. A modified operating method according to various embodiments has been employed for the last rolling stand 5 (cf. FIG. 4), and a conventional operating method has been employed for the first rolling stand 1. However, it is possible in principle to also operate the first and/or the last rolling stand 1, 5 on the basis of the same mode of operation explained above, in conjunction with FIG. 3, for the second, the third and the fourth rolling stands 2, 3, 4. By way of example, it is possible to arrange the front thickness-measuring device 11 prior to the first rolling stand 1 and also to detect or to determine the inlet-side velocity v0 of the strip 6 for the first rolling stand 1. A suitable measurement variable for the inlet-side velocity v0 for the first rolling stand 1 is, in particular, the circumferential velocity vR of the rollers of the front tension bridle 8. Analogously, it is possible to omit the rear thickness-measuring device 12. In this case, the strip thickness d5 of the strip 6 exiting the last rolling stand 5 is determined directly in accordance with the procedure of FIG. 3. All that is omitted is the detection of the final thickness d5' (steps S26 and S27) and the fact that further measures are taken (step S29).

The various embodiments have many advantages. In particular, the rolling stands 1 to 5 can be controlled in a considerably improved manner owing to the operating method according to various embodiments, in which

- firstly the present pass reduction of the rolling stand in question 2 to 5 in each case is determined from the ratio of the inlet-side and of the outlet-side velocities v1 to v5 of the strip 6, and
- secondly the determined strip thickness d2 to d5 is associated with the respectively rolled section 17 and the displacement of the respective section 17 through the rolling mill train is monitored, and a superior operating result can thus be obtained. In particular, the dimensional stability of the finished strip 6 can be improved considerably. This applies in particular to the area where operation is slow (for example when threading the strip 6 in and out or when changing over between two strips 6 in continuous operation). As a by-product, it is also possible to check strip thickness measurements for plausibility by comparing determined strip thicknesses d1 to d5 and measured strip or final thicknesses d1, d5'.

The above description serves exclusively to explain the present invention. However, the scope of protection of the present invention is intended to be determined exclusively by the appended claims.

The invention claimed is:

1. An operating method for a multi-stand rolling mill train, wherein a strip is fed to a rolling stand in question of the rolling mill train with a known input thickness and exits the rolling stand in question with a strip thickness, the method comprising:

- detecting measurement variables characteristic of the inlet-side velocity of the strip and the outlet-side velocity of the strip with respect to the rolling stand in question,
- determining the inlet-side velocity of the strip and the outlet-side velocity of the strip with respect to the rolling stand in question on the basis of the detected measurement variables,
- determining the strip thickness with respect to the rolling stand in question on the basis of the input thickness, the inlet-side velocity of the strip and the outlet-side velocity of the strip,
- taking further measures in the light of the determined strip thickness,
- wherein at least one of the measurement variable for the inlet-side velocity of the strip is the roller circumferential velocity of the rolling stand arranged immediately prior to the rolling stand in question and the measurement variable for the outlet-side velocity of the strip is the roller circumferential velocity of the rolling stand in question,
- modeling the peripheral precession of the strip in the respective rolling stand, and
- determining the respective velocity of the strip on the basis of the respective roller circumferential velocity and the peripheral precession of the strip in the respective rolling stand.

2. The operating method according to claim 1, wherein the strip consists of successive sections, a respective section thickness is associated with each section at any point in time, the displacement of the sections as they pass through the rolling mill train is monitored, and the section thickness of each section corresponds to the input thickness before said section enters the rolling stand in question and to the strip thickness after said section exits the rolling stand in question.

3. The operating method according to claim 1, wherein the input thickness is measured by means of a front thickness-measuring device arranged prior to the rolling stand in question.

4. The operating method according to claim 3, wherein the front thickness-measuring device is arranged between the first and the second rolling stands of the rolling mill train.

5. The operating method according to claim 1, wherein a rolling stand is arranged immediately prior to the rolling stand in question, and wherein the strip thickness for the rolling stand arranged immediately prior to the rolling stand in question is determined by means of the operating method.

6. The operating method according to claim 1, wherein the further measures include displaying the determined strip thickness.

7. The operating method according to claim 1, wherein the further measures include determining a control command for at least one of the rolling stand in question and at least one rolling stand of the rolling mill train which differs from the rolling stand in question.

8. The operating method according to claim 1, wherein an outlet thickness of the strip is detected by means of a rear thickness-measuring device arranged after the rolling stand in question, and the further measures include comparing the strip thickness determined for the rolling stand in question with the measured outlet thickness.

9. The operating method according to claim 8, wherein at least one of the inlet-side velocity of the strip and the outlet-side velocity of the strip are determined with respect to at least one of the rolling stands in question on the basis of the detected measurement variables using a determination method, and wherein the determination method is adapted on the basis of the comparison.

10. The operating method according to claim 8, wherein an error message is output if the determined strip thickness differs excessively from the measured outlet thickness.

* * * * *